US006584744B1

(12) United States Patent
Schultheis et al.

(10) Patent No.: US 6,584,744 B1
(45) Date of Patent: Jul. 1, 2003

(54) APPARATUS FOR SECURING A GLASS PLATE IN A RECESS

(75) Inventors: Bernd Schultheis, Schwabenheim (DE); Stefan Hubert, Bubenheim (DE)

(73) Assignee: Schott Glaswerke, Mainz (DE)

( * ) Notice: Subject to any disclaimer, the term of this patent is extended or adjusted under 35 U.S.C. 154(b) by 1752 days.

(21) Appl. No.: 08/541,586

(22) Filed: Oct. 10, 1995

Related U.S. Application Data

(63) Continuation of application No. 08/117,821, filed on Sep. 8, 1993, now abandoned.

(30) Foreign Application Priority Data

Jun. 7, 1993 (DE) ..... 43 18 854

(51) Int. Cl.[7] ..... E04F 15/22
(52) U.S. Cl. ..... 52/396.1; 126/211
(58) Field of Search ..... 52/208, 204.591, 52/204.593, 204.597; 126/211, 214 R, 214 A

(56) References Cited

U.S. PATENT DOCUMENTS

| | | | | |
|---|---|---|---|---|
| 4,243,016 A | * | 1/1981 | Kristen et al. | 126/211 |
| 4,453,533 A | * | 6/1984 | Scheidler et al. | 126/211 |
| 4,492,217 A | * | 1/1985 | Scheidler | 126/214 A |
| 5,036,831 A | * | 8/1991 | Ray | 126/211 |

FOREIGN PATENT DOCUMENTS

| | | |
|---|---|---|
| AT | 384 940 | 1/1988 |
| AU | 424301 | 9/1982 |
| DE | 33 37 148 | 4/1985 |
| EP | 0 531 227 | 3/1993 |

OTHER PUBLICATIONS

English translation to Austrian Patent No. 384,940.

* cited by examiner

*Primary Examiner*—Kien T. Nguyen
(74) *Attorney, Agent, or Firm*—Millen, White, Zelano & Branigan, P.C.

(57) ABSTRACT

A securing apparatus for a glass plate in a recess, especially a glass-ceramic cooking surface, is provided with easily removable components. The apparatus comprises a sealing frame; a holding frame connected to the sealing frame; a circumferential, permanently elastic sealing strip; and bonding. The sealing frame has an edge and is adapted to be positioned in the recess, lying on its edge. The holding frame is connected to the sealing frame and has an arm which supports the plate. The plate lies loosely without a secure connection to the holding frame with the permanently elastic sealing strip positioned therebetween. The sealing frame is connected non-positively, securely, and durably to the front surfaces or edge of the plate, and the sealing strip permanently prevents adhesive from leaking between the holding frame and the plate.

6 Claims, 2 Drawing Sheets

APPARATUS FOR SECURING A GLASS PLATE IN A RECESS

This application is continuation of application Ser. No. 08/117,821, filed Sep. 8, 1993 now abandoned.

FIELD OF THE INVENTION

The invention relates to an apparatus for securing a plate made of glass, glass-ceramic, or a similar material, especially a cooking surface, in a recess of, for example, a work surface. A visible sealing frame functions as a base when positioned in the recess lying on its edge, and a holding frame connected to the sealing frame functions as a support for the plate.

BACKGROUND OF THE INVENTION

Permanently elastic connections of glass, glass-ceramic, or similar brittle materials with one another or with other materials are typically made with silicone adhesives.

In particular, glass-ceramic cooking surfaces are typically glued in place with specific permanently elastic, temperature-stable silicone adhesives both on the holding frame and on the sealing frame, which typically comprise plastic-coated metal frames or high grade steel frames.

A heatable surface, such as a cooking surface, consisting of a glass or glass-ceramic plate, which is connected by a permanently elastic, heat-stable adhesive to a frame, is described in DE 28 19 118 C2. The frame consists of at least one frame profile and at least one secondary profile, which differ from one another in shape. The secondary profile at least partially overlaps or engages the frame profile and is placed at least partially between the frame profile and the glass or glass-ceramic plate. The secondary profile is connected to the frame profile by the permanently elastic adhesive.

This type of bonding has previously proven worthwhile in practice, but, if service is required, the replacement of a defective cooking surface is time consuming and thus costly. The cooking surface must be laboriously cut out from the permanently elastic bond for disassembly.

In view of the later reuse (recycling) of the components, a clean, easy, and economical separation of the cooking surface from the frame is necessary but is not possible with this type of bonding.

Cooking surface frame designs are also known in which the cooking surface is merely squeezed in the frame with a surrounding U-shaped rubber profile. These so-called overlapping frames permit relatively simple, economical disassembly but, like edging profiles, have the drawback that they limit the design possibilities and are not suitable for the majority of the frame designs which now exist.

DE 31 04 114 C2 describes a securing apparatus for a plate made of glass, glass-ceramic, or a similar material, especially a cooking surface, with a visible sealing frame which lies on the edge of an inset opening or on a base and a holding frame which is connected to the sealing frame. The holding frame is mechanically secured and durably connected to the plate with the aid of a permanently elastic, sufficiently temperature-stable adhesive. The sealing frame adjoins the plate in a sealing manner by a seal, which can comprise a permanently elastic adhesive or a rubber profile. The sealing frame and the holding frame are detachably connected to one another by at least one fastening element, and the seal between the plate and sealing frame is detachably connected to the sealing frame.

In this arrangement, the cooking surface is essentially glued in a two-part frame, where the upper part of the frame, with the cooking surface, is held in the lower part of the frame by various connecting elements. To accomplish this purpose, special and very expensive frame designs are necessary.

It is also known from DE 31 04 114 C2 to provide cooking surface frames with a separating layer so that a cooking surface with an adhesive edge can be squeezed out from the frame. However, the adhesive adhering to the glass-ceramic cooking surface prevents problem-free reusability.

SUMMARY OF THE INVENTION

An object of this invention is to provide a securing apparatus with a non-positive, permanently elastic connection between glass, glass-ceramic, as well as other brittle materials, with conventional frame materials, which is easy to disassemble from the apparatus as a whole, wherein the disassembled materials are maintained in pure grade, uncontaminated, and free from adhesions of other materials.

It is also the object of the invention to provide a securing apparatus with a non-positive, permanently elastic connection between glass, glass-ceramic, as well as other brittle materials, which can utilize conventional frame materials, and conventional frame systems without any change in the design of the cooking surface-frame bondings.

A further object of this invention is to provide a securing apparatus with a non-positive, permanently elastic connection between glass, glass-ceramic, and other materials, wherein the components are configured to provide for easy assembly and protection from damage during transport.

Upon further study of the specification and appended claims, further objects and advantages of this invention will become apparent to those skilled in the art.

The above objects are achieved through this invention by providing a securing apparatus which comprises a visible sealing frame having an edge which typically extends outwardly relative to the plate, a holding frame with an arm which typically extends inwardly relative to the plate, a permanently elastic sealing strip, and bonding. The sealing frame functions as a base, lying on its edge, when positioned in the recess. The plate lies loosely without secure connection to the arm of the holding frame, with a circumferential, permanently elastic sealing strip positioned between the plate and the holding frame arm. The sealing frame is connected non-positively, permanently, and durably to the front surfaces of the plate, and the distance between the sealing frame and the front surface or edge of the plate is equal to or greater than the distance between the sealing frame and the sealing strip on which the plate lies.

The cooking surface is thus glued non-positively in the apparatus of this invention only on the front surfaces, such as along the edge. Safety and serviceability of the cooking surfaces are not impaired by this configuration.

DETAILED DESCRIPTION OF TEE PREFERRED EMBODIMENTS

Figure 1:
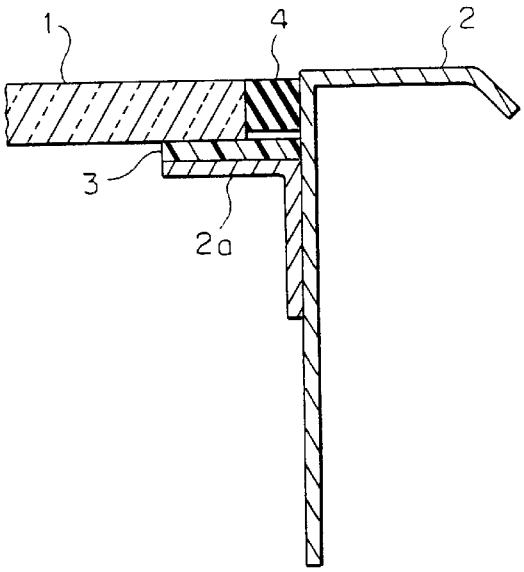
FIG. 1 shows a cross-section through a cooking-surface frame interconnection provided by an apparatus of the invention.

In the present invention, the distance between the sealing frame and the front surfaces, such as the edge of the plate, must be equal to or greater than the distance between the sealing frame and the permanently elastic sealing strip which lies between the plate and the holding frame to prevent adhesive from being able to penetrate between the holding frame and the plate.

Conventional adhesives typically achieve an adhesive strength of more than 1 $N/mm^2$.

Because of the circumferentially large adhesive surface of typically 200 to 300 $cm^2$ used in conventional bondings in the support area and on the front sides of the plate, adhesive forces are produced which far exceed actually occurring stresses because of varying thermal expansion, as well as mechanical stresses, such as, e.g., impact stresses.

In the apparatus according to the present invention, a reduced adhesive surface of about 80 $cm^2$ is utilized, from which adhesive strengths result which, in the case of thermal and mechanical stresses, still form a great safety margin so that safety and serviceability are maintained.

In the preferred embodiment, the permanently elastic sealing strip fits flush with the sealing frame; consists of a temperature-stable material, especially a silicone material; and is self-adhesive in certain embodiments.

It has proven advantageous in many tests that the sealing strip used for permanent elastic mounting of the plate exhibit stepped shoulders, since the positioning and centering of the plate is fixed exactly by one shoulder and the joint spacing between the sealing frame and plate by the other shoulder.

It is also easy to assemble if, according to the invention, (1) the sealing strip is U-shaped, (2) can be secured on the holding frame, and (3) is detachably connected to the holding frame. This provides a well-defined, simple position of the sealing strip on the holding frame.

In the holding arrangement according to the invention, the non-positive connection between the sealing frame and plate is provided with a permanently elastic, temperature-stable adhesive, especially a silicone adhesive.

The great advantage of this type of assembly is that in disassembly, only the adhesive seam easily accessible from above is cut open circumferentially with a sharp cutter or scalpel. The cooking surface can then be easily removed from the securing apparatus, e.g., pressed out of the assembly from below or lifted upward with a vacuum suction device.

If the sealing strip which assures the permanently elastic mounting of the plate on the holding frame is already connected to the plate in the factory and is not first glued to the holding frame, assembly is simplified; moreover, excellent transport protection results which makes possible reliable handling of the plate from the manufacturer to assembly.

The sealing strip or a corresponding sealing bead made of temperature-stable, permanently elastic material can also be applied to the holding frame in the factory by the frame manufacturer so that only the front-side, non-positive bonding between the sealing frame and plate has to be performed during assembly.

FIG. 1 shows a sealing frame 2, which can consist, e.g., of high grade steel, powder-coated high grade steel, enameled sheet steel, or aluminum die casting. Where plate 1 is a glass-ceramic cooking surface, sealing frame 2 typically has dimensions of from about 270×270 mm to 900×560 mm. The interconnection of sealing frame 2 and holding frame 2*a* and the plate/cooking surface 1 are cleaned in the mutual contact area, e.g., with alcohol.

Holding frame 2*a* is covered with a temperature-stable, permanently elastic sealing strip 3, which is preferably provided with a self-adhesive layer for fastening onto holding frame 2*a*. This sealing strip 3 can consist, for example, of pre-extruded silicone, which can be obtained on rolls.

Moreover, other, preferably self-adhesive sealing strips, which meet the following requirements, can also be used:

temperature-stable to a minimum of 150° C., preferably 180° C., permanently elastic, no release of health-threatening substances when the cooking area is used.

The sealing strip 3 is preferably 8–10 mm in width and 1–2 mm thick. The dimensions are determined by the support width of the holding frame 2*a*.

In this connection, care is to be taken that sealing strip 3 is not too high so that plate/glass-ceramic cooking surface 1 does not project over the upper side of the sealing frame 2. In a preferred embodiment, the plate/glass-ceramic cooking surface 1 ends below the upper side of the sealing frame 2 and thus forms sufficient space for food that has boiled over while being cooked. Bonding 4 typically comprises a temperature-stable, permanently elastic adhesive.

In the assembly of the securing apparatus of this invention, with sealing frame 2, holding frame 2*a*, and sealing strip 3 in place, plate 1, preferably a glass-ceramic cooking surface, is put on sealing strip 3 loosely and centered so that, circumferentially, there remains a uniformly wide groove relative to sealing frame 2, preferably (2.5+1 mm) wide, which is filled with permanently elastic silicone adhesive to form bonding 4.

Figure 2:
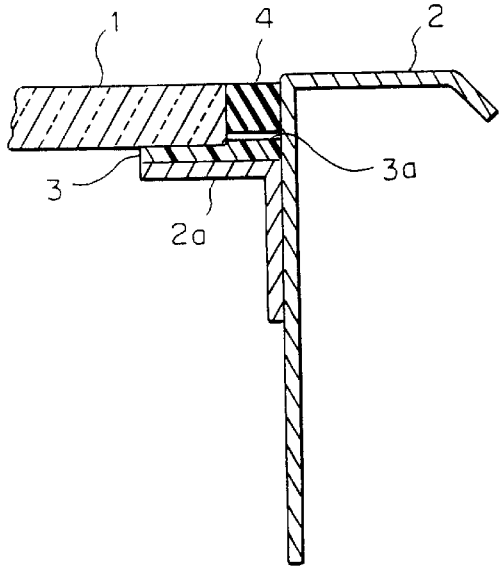
FIG. 2 illustrates a cross-section through a cooking surface frame interconnection provided by an embodiment of this invention having a stepped, profiled shoulder.

FIG. 2 shows an embodiment in which sealing strip 3 has a stepped shoulder 3*a* which is used for easier positioning of the plate 1.

Figure 3:
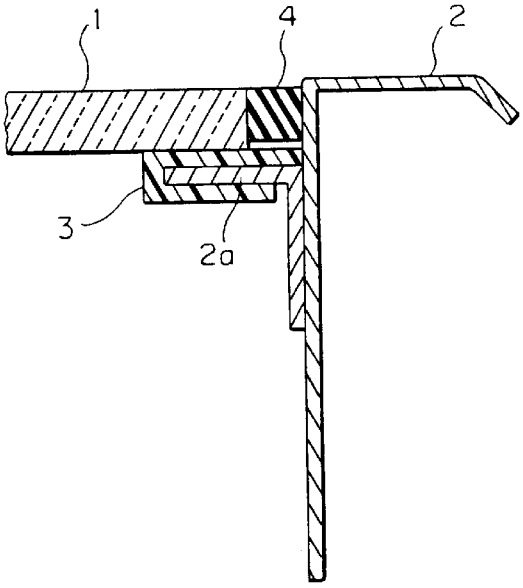
FIG. 3 shows a cross-section through a cooking surface frame interconnection provided by another embodiment of this invention having a U-shaped sealing profile which can be put on the holding frame and is detachably connected to it.

In FIG. 3, sealing strip 3 is U-shaped and is inserted over the leg of holding frame 2*a*.

Figure 4:
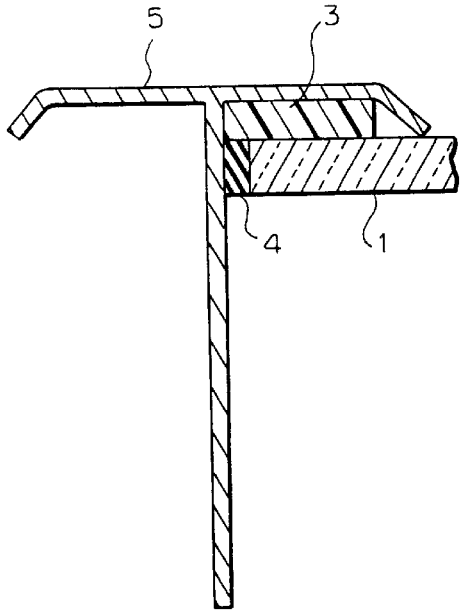
FIG. 4 illustrates a cross-section through a cooking surface frame interconnection provided by another embodiment of this invention having an overlapping T-shaped frame system with an overhead bonding of the plate with the frame.
Figure 5:
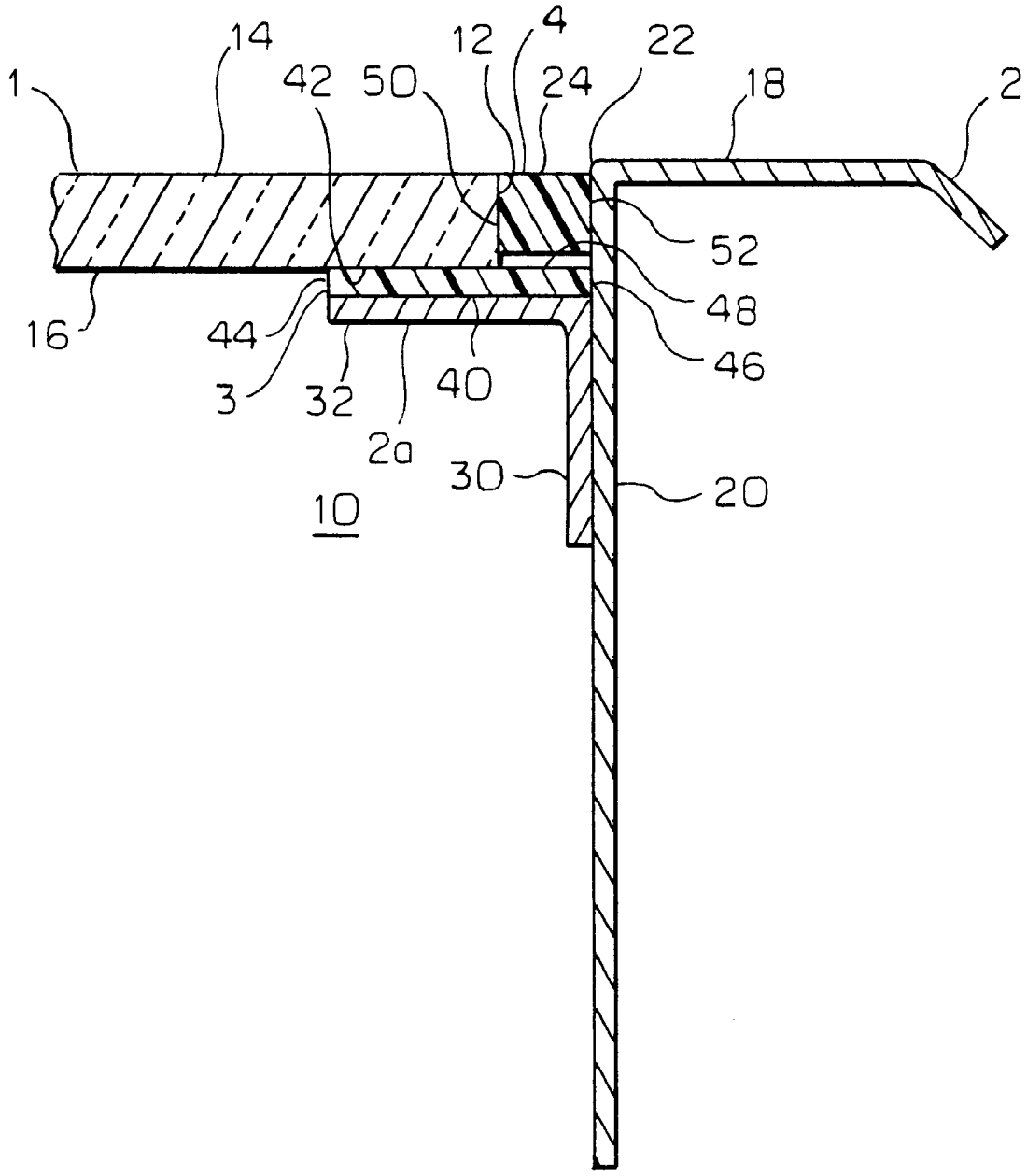
FIG. 5 is an enlarged view similar to FIG. 1 with additional reference numerals.

FIG. 4 shows an overlapping T-shaped frame system 5, wherein the sealing frame and holding frame are combined. Sealing strip 3 is positioned above plate 1, and bonding 4 provides an overhead bond between plate 1 and frame system 5.

In the embodiment of FIG. 4, disassembly is also simplified if bonding takes place only between the front side or edge of plate 1 and frame system 5, and a permanently elastic sealing strip 3 is placed between the plate 1 and the one overlapping leg of frame system 5.

The embodiments of FIGS. 1–3 are directed to a mounting arrangement for mounting in a recess 10 a plate 1 made of glass, glass ceramic or a similar brittle material, wherein the plate has a selected area, a peripheral edge 12, a top surface 14 and a bottom surface 16. The plate 1 has an area of a selected size.

The sealing frame 2 includes a horizontal flange 18 for projecting beyond the recess 10 and a vertical flange 20 for insertion into the recess. When the sealing frame 2 is mounted with the vertical flange 20 projecting into the recess 10, the sealing frame has an inner peripheral portion 22 which defines an area larger than the area of the plate 1. Accordingly, when the plate 1 is mounted in the sealing frame 2, there is a peripheral gap 24 between the periphery 12 of the plate 1 and the inner periphery 22 of the sealing frame. The holding frame 2*a* includes a mounting flange 30 and a ledge 32. The mounting flange 30 is fixed to the vertical flange 20 of the sealing frame 2 and the ledge 32 extends into the recess 10 in a direction opposite the horizontal flange 18 of the sealing frame 2. The ledge 32 is disposed below the horizontal flange 18 of the sealing frame 2 at a selected vertical distance therefrom. The permanently elastic sealing strip 3 has a first side 40, a second side 42, an outer edge 44 and an inner edge 46. The first side 40 abuts the ledge 32 and is bonded thereto and the second side 42 is abutted by, but not adhered to, the bottom surface 16 of the plate 1 when the plate is mounted thereon. The elastic sealing strip 3 has an outer peripheral portion 48 extending beyond the peripheral edge 12 of the plate 1 when the plate is mounted thereon.

The strip of bonding material 4 is separate from the elastic sealing strip 3. The strip of bonding material 4 has first and second vertical sides 50 and 52 and is bonded to the peripheral edge 12 of the plate 1, as well as to the vertical flange 20 of the sealing frame. The bonding strip 4 bridges the gap 26 and adheres to the peripheries 12 and 22. The material of the bonding strip does not flow between the permanently elastic sealing strip 3 and the plate 1 because the bottom surface 16 of the plate 1 and the top surface 42 of the sealing strip 3 are in abutment with one another.

As has been emphasized previously, the plate 1 is a cook top for a stove and is preferably slightly below the level of the horizontal flange 18 so that, if there are spills on the cook top, the spills tend to be retained by this difference in height.

In the embodiment of FIG. 4, the entire unit, including the frame system 5 and plate, must be removed from the work surface and rotated for disassembly. Removal of plate 1 is performed from below by cutting open the adhesive groove.

The advantages of the invention include:

- the cooking surface can be quickly and easily detached from the frame interconnection from above by cutting open the circumferential adhesive groove about the cooking surface with a sharp cutter, e.g., a carpet cutter or scalpel;
- small residues of adhesive on the front sides or edges of the plates are easy to remove with the cutter for reuse of the plate;
- the frame components can be freed of adhesive in the same simple way;
- depending on the requirements, only 25–40% of the amount of adhesive used in conventional framing systems is necessary; and
- conventional cooking-surface frame systems which are glued can continue to be used without any change.

We claim:

1. In combination, an arrangement comprising:

a plate made of glass, glass-ceramic, or a similar brittle material, wherein the plate is a cook top for a stove and has a selected area, a peripheral edge, a top surface and a bottom surface;

a sealing frame adapted for mounting in a recess and receiving the plate, the sealing frame having a horizontal flange for projecting beyond the recess and a vertical flange for insertion into the recess when the sealing frame is in the recess, the sealing frame defining an inner peripheral area larger than the area of the plate, so that when the plate is mounted in the sealing frame, there is a peripheral gap therebetween;

a holding frame including a ledge permanently fixed with respect to the vertical flange of the sealing frame, the ledge extending into the recess in a direction opposite the horizontal flange of the sealing frame and the ledge being disposed below the horizontal flange of the sealing frame at a selected distance therefrom;

a permanently elastic sealing strip having a first side, a second side, an outer edge and an inner edge, the first side abutting and adhered to the ledge and the second side being abutted by but not adhering to the bottom surface of the plate because the plate is loosely mounted thereon, the elastic sealing strip having an outer peripheral portion extending beyond the peripheral edge of the plate toward the vertical flange of the sealing frame when the plate is mounted thereon; and a strip of bonding material, the strip of bonding material being separate from the elastic sealing strip, the strip of bonding material having first and second vertical sides and being bonded to the peripheral edge of the plate and the vertical flange of the sealing frame while extending across the gap between the peripheral edge of the plate and the vertical flange of the sealing frame, whereby the plate is separable from the sealing frame upon severing the bonding strip.

2. The mounting arrangement of claim 1, wherein the permanently elastic sealing strip extends flush with the sealing frame.

3. The mounting arrangement of claim 1, wherein the permanently elastic sealing strip is comprised of a temperature-stable material.

4. The mounting arrangement of claim 1, wherein the lower surface of the permanently elastic sealing strip is self-adhesive for bonding to the ledge.

5. The mounting arrangement of claim 1, wherein the bonding material stored between the sealing frame and plate is a permanently elastic, temperature-stable adhesive.

6. The mounting means of claim 1, wherein the holding frame and the sealing frame are offset, said sealing frame extending vertically above said holding frame and wherein said sealing strip lies in a single horizontal plane and has a uniform thickness.

* * * * *